US005344277A

United States Patent [19]

Sandland

[11] Patent Number: 5,344,277

[45] Date of Patent: Sep. 6, 1994

[54] STRAPPING EQUIPMENT

[76] Inventor: Tony Sandland, 1 Wingate Close, Nottingham, NG8 4LB, England

[21] Appl. No.: 117,253

[22] Filed: Sep. 3, 1993

[51] Int. Cl.[5] ..... B65D 19/38

[52] U.S. Cl. ..... 414/607; 410/97; 414/785

[58] Field of Search ..... 414/607, 785; 410/96, 410/97

[56] References Cited

U.S. PATENT DOCUMENTS

| | | | |
|---|---|---|---|
| 2,623,760 | 12/1952 | Fornelius | 410/97 |
| 2,941,683 | 6/1960 | Fowler | 414/607 |
| 3,753,407 | 8/1973 | Tilseth | 410/97 |
| 3,947,064 | 3/1976 | Skoting | 414/607 |
| 5,069,596 | 12/1991 | Mueller et al. | 414/607 |

*Primary Examiner*—Michael S. Huppert
*Assistant Examiner*—Thomas J. Brahan
*Attorney, Agent, or Firm*—Jones & Askew

[57] ABSTRACT

Strapping apparatus for applying strapping to packages, and in particular to packages mounted on pallets, including at least one fork which may also be used to lift the pallet, a strapping retaining mechanism attached to a distal end of the fork, strapping guide mechanism and a strapping coil dispenser mechanism. The apparatus may be provided on a trolley or integrally mounted on a fork lift truck, pallet truck or other suitable vehicle. The strapping of the package can be readily attended to during the operation of manoeuvring the goods around a warehouse.

9 Claims, 6 Drawing Sheets

STRAPPING EQUIPMENT

The present invention relates to equipment for strapping packages, and in particular for strapping packages to a pallet bearing such a package. Such strapping operations typically use metal, plastic or other suitable strapping material well known in the art, which is used to encircle the package or goods being strapped, and in particular, may pass beneath a pallet upon which the package rests, or preferably through a cavity in the pallet. Such cavities, or voids are commonly provided for the use of pick-up equipment such as a fork-lift truck, or pallet truck.

In attaching the package to the pallet it is commonly necessary to pass a free end of the strapping material beneath the pallet, or through the pallet voids to facilitate the encircling of the package with the strapping material. Such an operation can be inconvenient and time consuming. It is thus desirable to improve the modus operandi of this activity.

Commonly, the package will be moved after strapping by means of a fork-lift truck, pallet truck, or other suitable means. The method of the present invention can include such operations in combination with the strapping operation.

It is therefore an object of the present invention to provide means for assisting the strapping operation. It is a further object of the invention to incorporate such means into a convenient apparatus capable of moving the pallet after strapping to simplify the overall operation.

According to the present invention, there is provided a strapping apparatus for applying strapping to packages, said strapping apparatus comprising:

at least one fork having a proximal end and a distal end, and having retaining means for gripping said strapping at said distal end;

guide means cooperative with said at least one fork, for feeding said strapping therethrough to said retaining means; and dispensing means cooperative with said guide means for supplying strapping material to said retaining means and said guide means.

Embodiments of the present invention will now be described by way of example, and with reference to the accompanying drawings in which.

Figure 2:
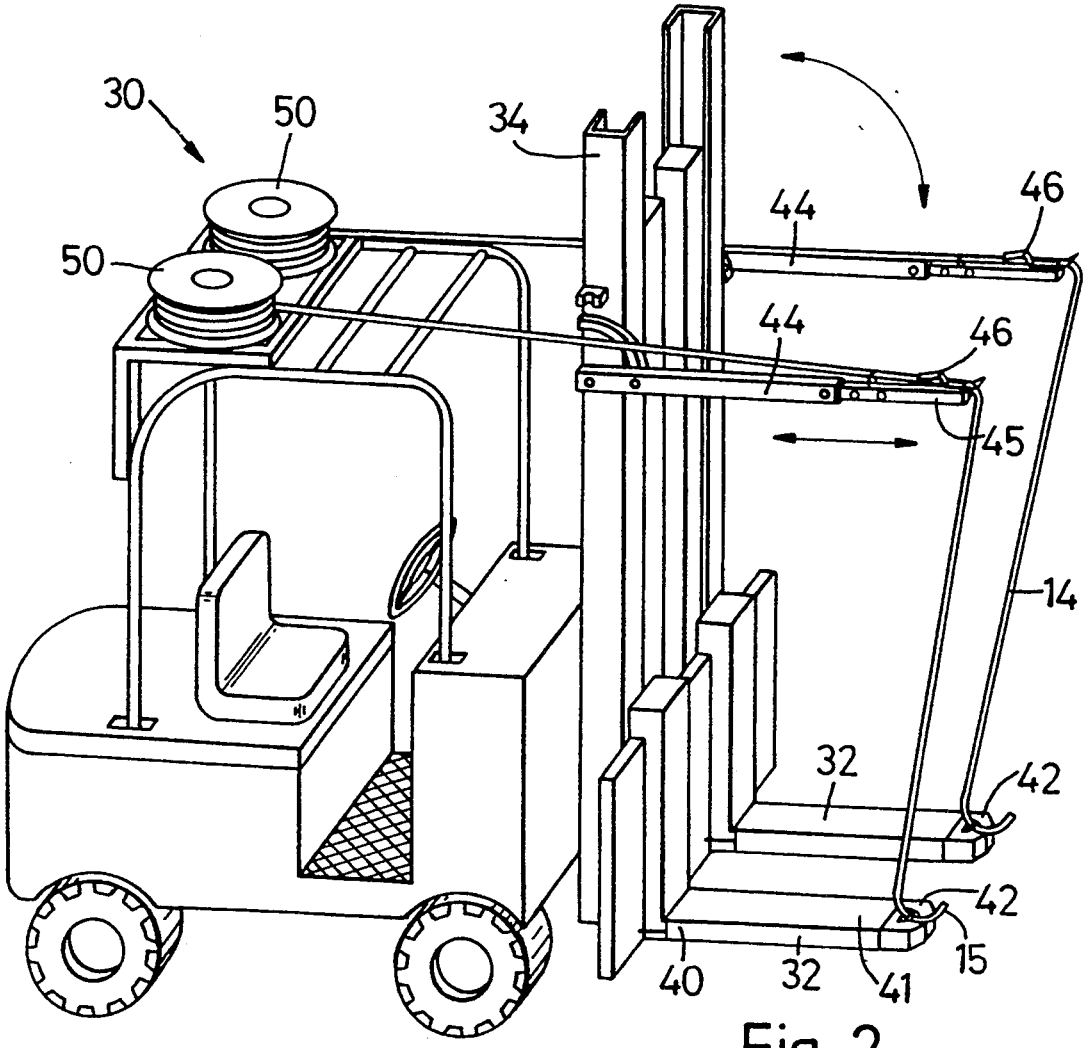
FIG. 2 shows a fork-lift truck incorporating an embodiment of the present invention.
Figure 8:
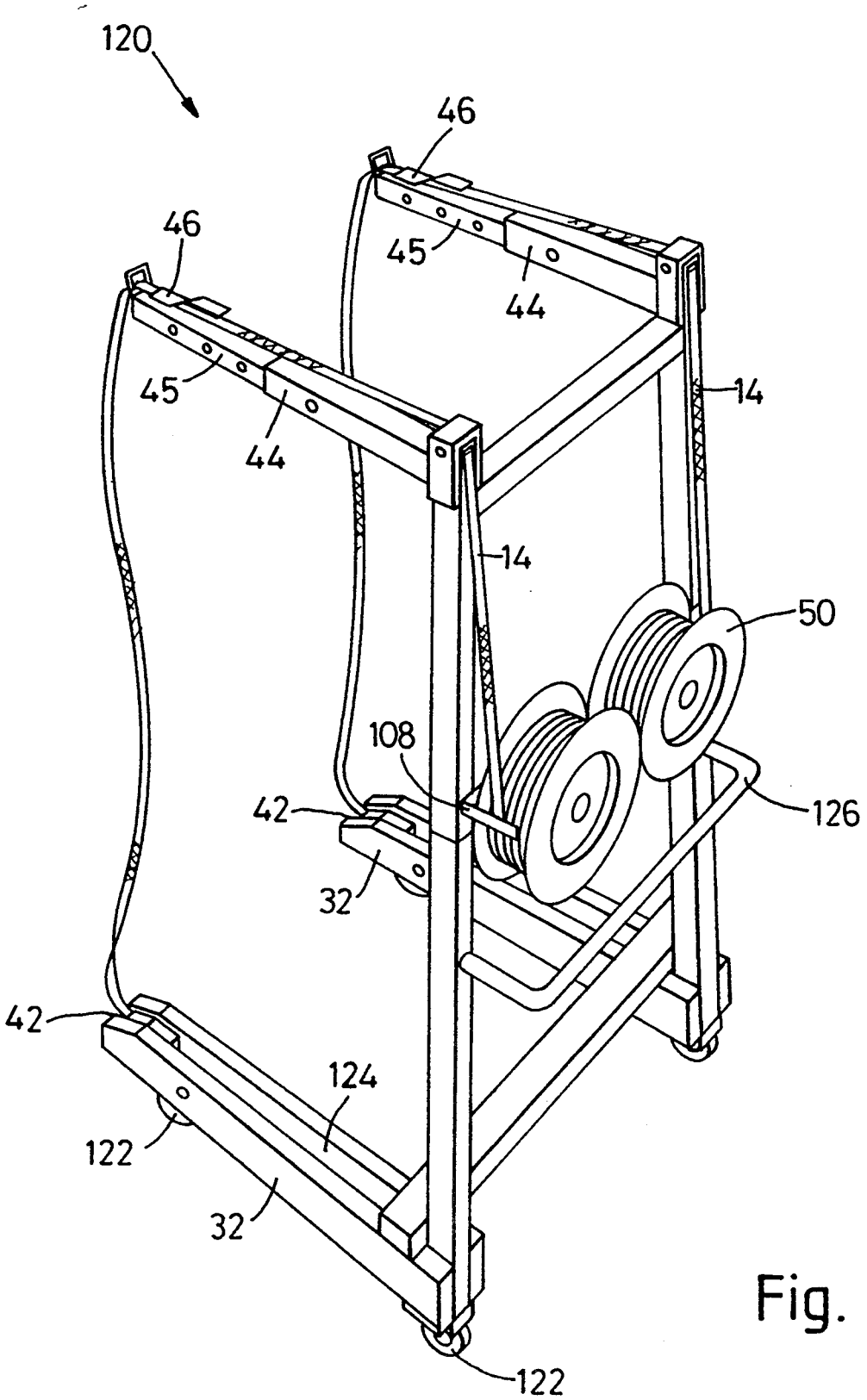

FIGS. *7a* and *7b* show a braking mechanism suitable for use with the strapping coil dispenser mechanisms in FIG. 2; and FIG. 8 shows an alternative embodiment of the present invention.

Figure 1:
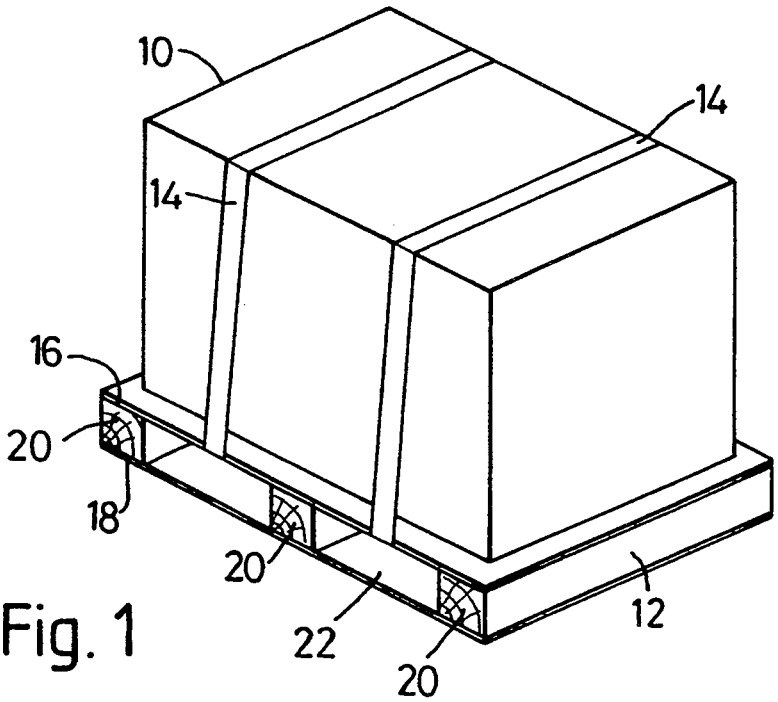
FIG. 1 shows a package strapped to a pallet in known manner.

With reference to FIG. 1, there is shown a typical arrangement of a package 10 strapped to a pallet 12 by means of two straps 14 which pass around the package, and between an upper platform 16, and a lower platform 18 of the pallet 12. The upper and lower platforms are typically separated by cross-members 20, thus defining one or more voids 22 through which the strapping may pass. Variations on this arrangement are well known, and the present invention is not limited to this particular arrangement of pallet. It will be clear upon reading the specification that strapping of packages 10 on a pallet not completely defining a void is possible (i.e. without lower platform 18). It will also be clear that the strapping of the package 10 without including a pallet 12 is possible providing that the package is temporarily supported with at least some clearance beneath the package to allow access of apparatus according to the present invention described hereinafter. It will also be clear that the apparatus is also suited to a two-way strapping operation, in which a four-way entry pallet is used, e.g. two strapping operations may be carried out at a ninety degree angle to one another on a pallet with void entries on all sides.

With reference to FIG. 2 there is shown a fork-lift truck 30 in which apparatus according to the present invention has been integrally mounted thereon.

For the avoidance of doubt, the expression "fork" is used throughout the present specification, including the claims appended hereto, to indicate a single prong or bar such as shown as 32 in FIG. 2. Thus the present invention is not limited to a typical arrangement of a two-pronged apparatus as shown in the figure.

In a typical arrangement, and as shown in FIG. 2, the forks 32 are moveable in the vertical direction by lift mechanism 34 for the lifting of a package 10, but as will be seen, this is not essential to the invention. The forks 32 are attached to the fork-lift truck 30 at or near to a proximal end 40 of each fork, and project away from the vehicle to distal ends 41. Strapping material 14 is attached to the forks at the distal ends by a retaining mechanism 42, examples of which will be described in greater detail with reference to FIGS. 3, 4 and 5. A pair of support arms 44 each corresponding to a fork are preferably provided to support a guiding mechanism 46, through which the strapping material 14 passes. Examples of the guiding mechanism 46 will be described in greater detail with reference to FIG. 6.

In a preferred embodiment, and as shown, the support arms 44 are of extendable length each having a telescopic section 45 to enable the guiding mechanisms 46 to be re-positioned approximately vertically above the corresponding retaining mechanism 42, as indicated by the lower arrow. This enables the guiding mechanism 46 to be projected beyond the package being strapped, allowing access by a person operating the strapping equipment. In the embodiment shown, the arms are pivotally attached to the housing of the lift mechanism 34 enabling the arms to be pivoted to a vertical orientation as indicated by the upper arrow. This enables the fork-lift mechanism 34 to be raised in a normal manner, without obstruction by the arms 44. There may also be provided a latch mechanism (not shown) to retain the arms 44 in such a vertical orientation.

Figure 7A:
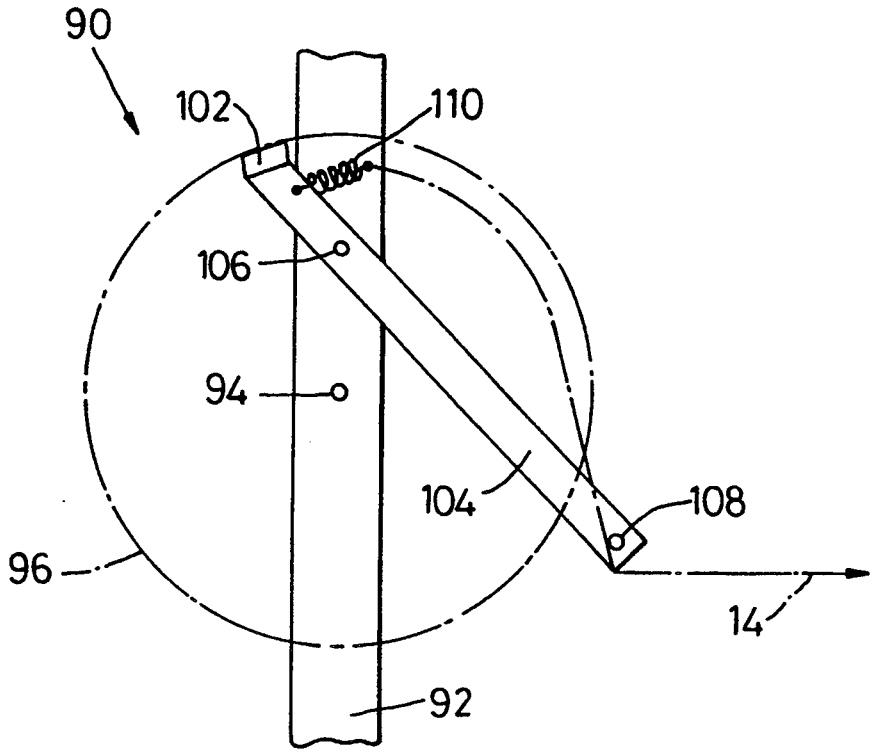
Figure 7B:
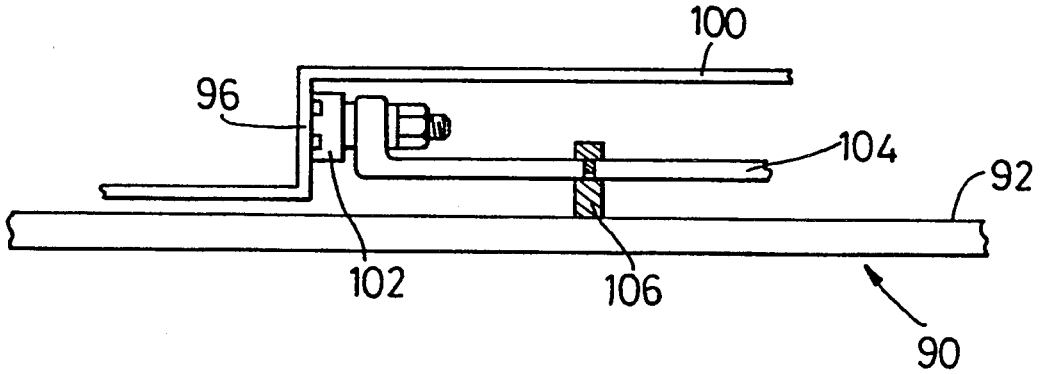

In a preferred embodiment, and as shown, strapping dispensers 50 are located on the top of the fork-lift truck 30, which feed strapping material to the guide mechanisms 46, but such dispensers could be mounted at any suitable location. Strapping material is customarily provided on reels such as those shown, although any appropriate dispensing means will be adequate to the invention. In the embodiment shown, strapping coils are mounted on the dispensers 50, and include a braking mechanism or friction feed to prevent uncontrolled uncoiling of the strapping, in known manner, such as will be described in greater detail with reference to FIG. 7.

Figure 3:
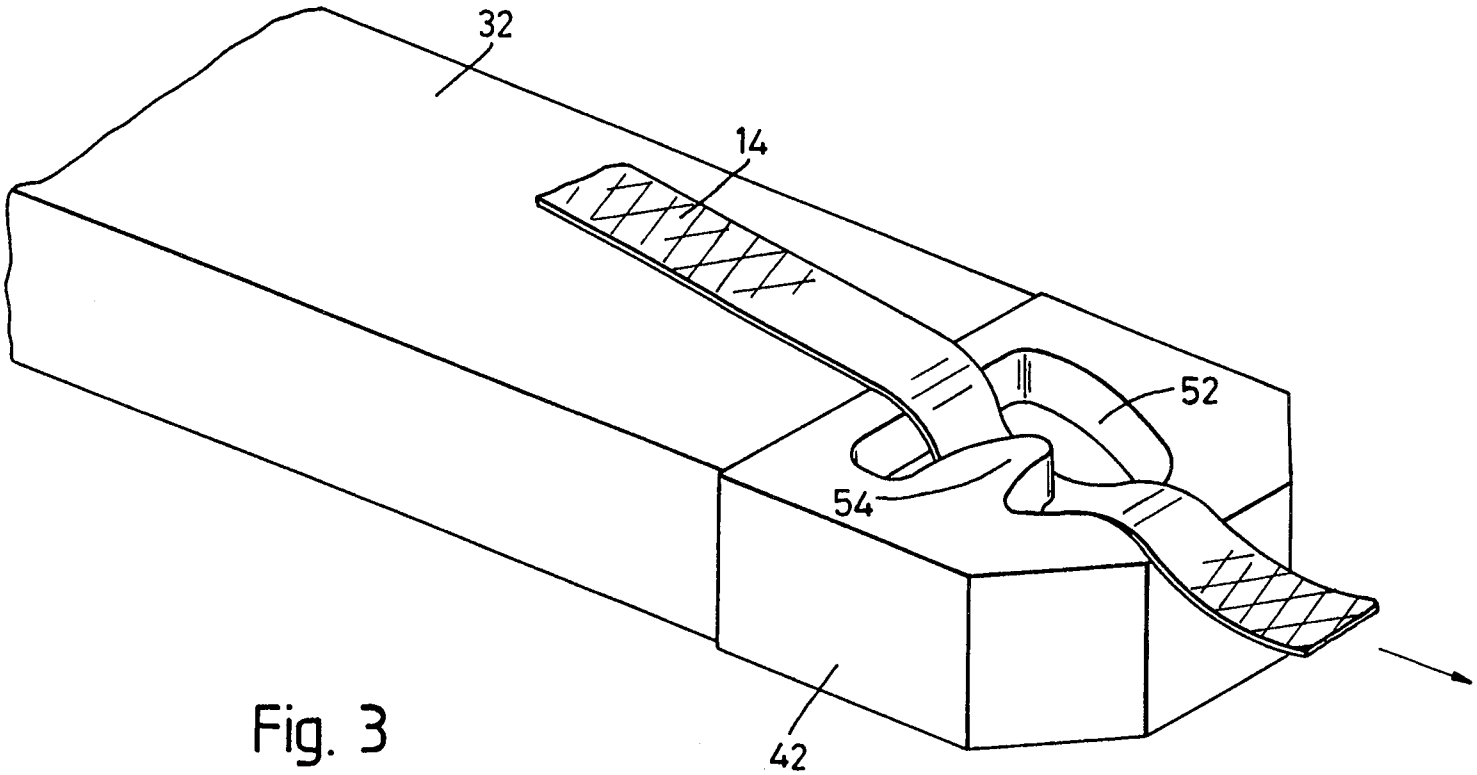
FIG. 3 shows a detailed perspective view of the top of strapping retaining means suitable for the apparatus of FIG. 2.
Figure 4:
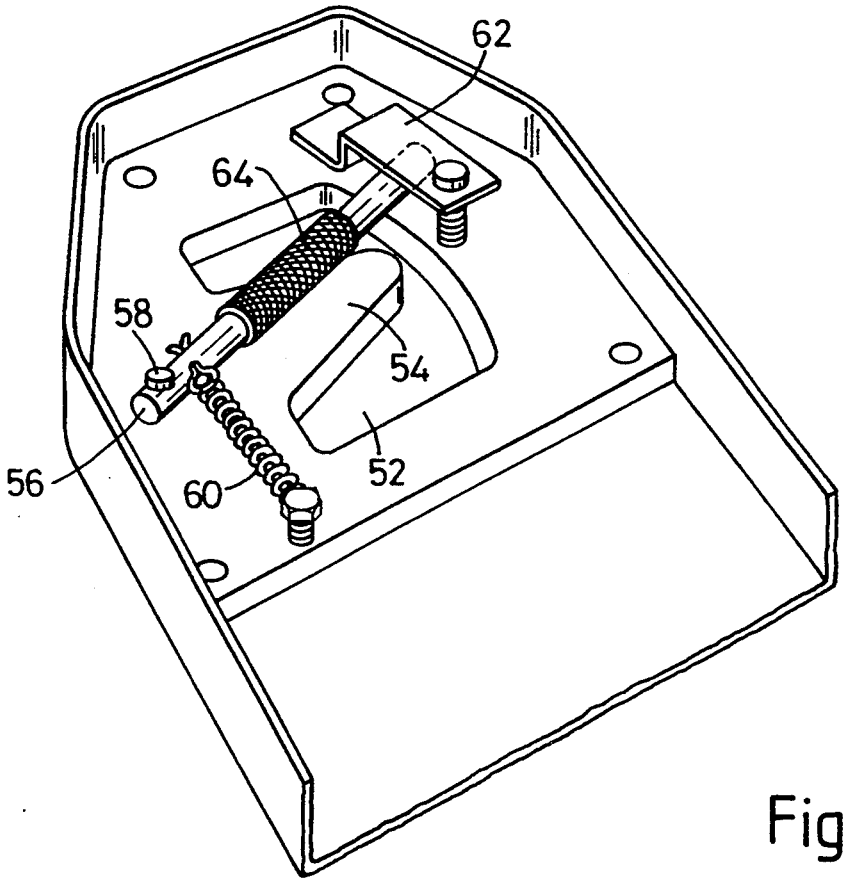
FIG. 4 shows a detailed perspective view of the underside of the strapping retaining means of FIG. 3.

Referring to FIGS. 3 and 4, there is shown an example of a retaining mechanism 42 situated on the distal end of fork 32. Such a mechanism may be attached by the use of extension forks, or may be included in a specially modified extension fork which can conveniently be attached using known methods, and removed from the forks when not in use. The retaining mechanism 42 may also be incorporated into a specially adapted fork. Retaining mechanism 42 comprises a housing defining an aperture 52, into which lug 54 projects in the horizontal plane. On the underside of the housing (see FIG. 4) a retaining bar 56 is mounted by pivot 58 beneath the aperture 52 and lug 54. Bar 56 is biased by spring 60. At the opposite end of the bar to the pivot 58, movement of the bar 56 is restricted by guide plate 62 to a limited degree of arc about pivot 58. The pivot 58 and guide plate 62 are configured such that the plane of rotation of the bar is not exactly parallel to the underside of lug 54, such that when the bar is positioned for minimum spring tension, a knurled surface 64 of the bar comes into contact with underside of lug 54, and when the bar 56 is positioned for maximum spring tension, the knurled surface 64 is separated from the underside of lug surface 54.

Thus, as shown in FIGS. 3 and 4, when strapping material 14 is pulled toward the distal end of the fork, in the direction shown by the arrow (FIG. 3), simultaneously with hooking the strapping around lug 54, the knurled retaining bar 56 is pulled forwards against the bias of spring 60, and thus away from the underside of lug 54. Spring 60 then returns the bar 56 to its first position, gripping the strapping between knurled surface 64 and lug 54. Backward tension on the strapping material will tend to tighten this grip. Further forward tension on the strapping material will, however, tend to permit release of the strapping.

Figure 5:
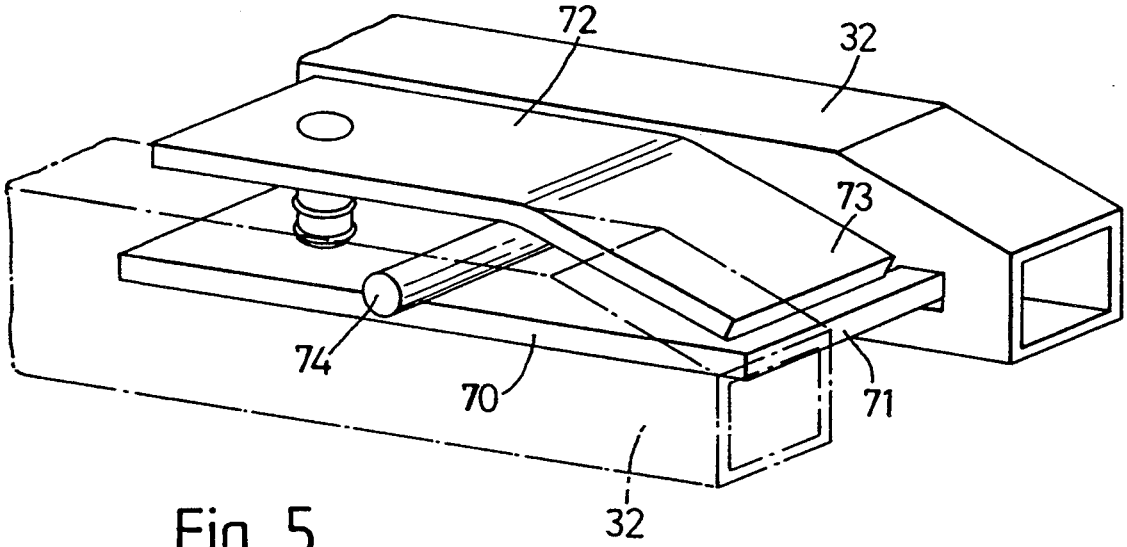
FIG. 5 shows a detailed perspective view of another embodiment of the strapping retaining means.

As will be readily apparent, any suitable retaining means may be used, and a further example is shown in FIG. 5. In this embodiment, an upper plate 72 and lower plate 70, each having a "jaw" end 73 and 71 respectively, are separated by rocker bar 74 and spring 76. The spring 76 operates to maintain the jaws 71,73 in closed position unless the upper plate 72 is depressed in the vicinity of upper surface 78 over the spring 76. Strapping 14 is passed over the forks and the retaining mechanism 42, and the free end 15 is inserted between jaws 71,73.

Figure 6:
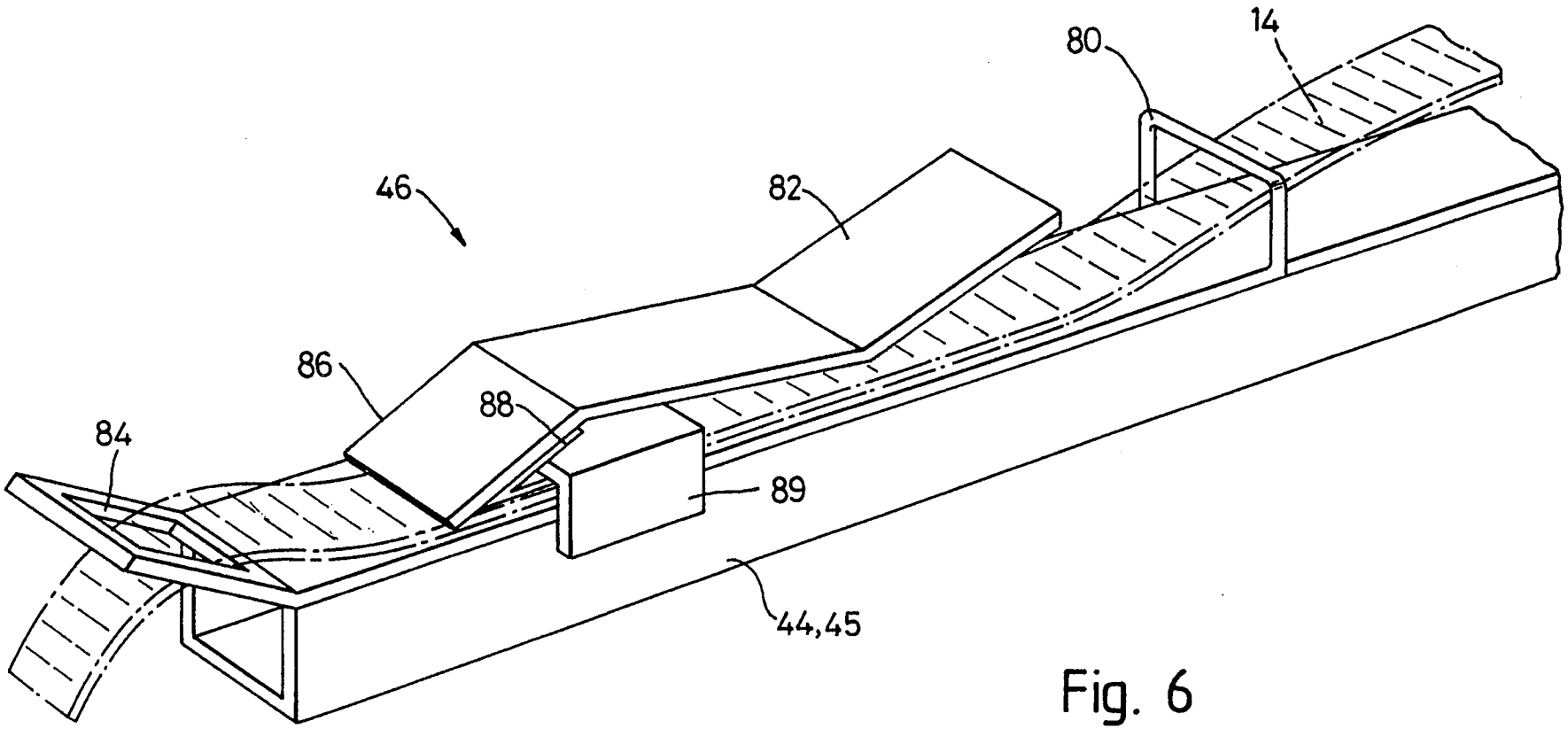
FIG. 6 shows a detailed perspective view of strapping guide means suitable for the apparatus of FIG. 2.

Referring now to FIG. 6, there is shown an example of a guiding mechanism 46. Mounted on support arms 44 (or extension 45) is strap guide 80, leading strap guide 84 and strap clamp 82. The strapping 14 (shown in dotted outline) passes from strapping dispensers 50 (not shown) through strap guide 80 and under strap clamp 82. Strap clamp 82 includes a "jaw" portion 86 which is biased against support arm 44,45 by spring mechanism 88, which is affixed to housing 89. The strapping 14 passes through housing 89, prior to the "jaw" of strap clamp 82. The leading strap guide 84 prevents lateral movement of the strapping. The spring mechanism is arranged such that sufficient compression on the strap is applied by jaw 86 to allow passage of the strap through the guides when greater than a predetermined force has been applied to the strapping, while maintaining sufficient tension to prevent slack between the dispensers 50 and the guiding mechanism.

Referring now to FIGS. *7a* and *7b*, there is shown a braking mechanism 90 suitable for use with the strap dispensers 50. FIG. *7a* shows a plan view of the braking mechanism, and FIG. *7b* shows an enlarged side view of a brake arm and brake block mechanism. Strapping dispensers 50 are mounted on a suitable supporting structure, such as bar 92, and have a base 100 (not shown in FIG. *7a*, so as to reveal the braking mechanism) upon which the strapping coils may be mounted on a spindle 94 projecting upward from the base. The base 100 has a lower inner rim 96 (shown dotted on FIG. *7a*) defining an inner surface to which brake block 102 may be applied. Brake block 102 is supported by a brake arm 104 which is rotatably mounted on the bar 92 at pivot 106. At the opposite end of the brake arm 104 a strap roller 108 projects upwards, parallel to the outer circumference of the cylindrical strapping coil, such that strapping material 14 (also shown dotted) departs from the coil around the roller 108. A spring 110 is provided to bias the brake arm 104 in a manner tending to apply the brake block 102 to the inner rim 96. However, in use, the tension pulling on strapping 14 in the direction indicated by the arrow will tend to oppose the action of the spring by bearing on the roller 108 thus causing the brake arm 104 to rotate about pivot 106, releasing the brake block 102 from rim 96.

It will be readily apparent that this relatively simple apparatus could be replaced by many different mechanisms suitable for providing the braking means.

It is not essential that the present invention described herein be applied to a fork-lift truck. Pallet trucks are well known, and provide a wheeled fork mechanism with limited lift capability to facilitate the transportation of pallets around a warehouse. Such apparatus as previously described can readily be adapted to be integrally mounted thereon.

Alternatively, the present invention may be provided by way of an apparatus separate from any transportation facility. Such an embodiment is described with reference to FIG. 8.

In FIG. 8, the essential features of the invention do not form an integral part of a fork-lift truck, but are attached to a trolley 120. Where individual components perform substantially identical functions as those previously described with reference to earlier drawings, the same reference numerals have been employed.

In this embodiment, the forks 32 are provided with wheels 122 to facilitate movement of the apparatus to the pallet and/or package. The forks are of two part construction allowing a channel or gap 124 between the portions in which the strapping may lie if necessary. Alternatively, the forks may be similar to those already described herein. The forks 32 are provided with a retaining mechanism 42 in similar manner to those already described herein. Support arms 44,45 are provided in similar manner, and strapping coils 50 are mounted on the rear of the structure 120 in convenient manner. The trolley 120 may be provided with handle 126 for manoeuvring around a warehouse.

In operation, the strapping material is passed through the strapping guide mechanism 46 and down to retaining mechanism 42 where it is clamped. The fork-lift truck 30, or trolley 120 is manoeuvred up to the package-bearing pallet 12, and the forks pass beneath the pallet, or through the voids 22 of the pallet. The pallet and package cause the strapping material to be pulled from the dispensers 50 via retaining mechanism 42 as the forks pass thereunder. The support arms 44,45 reach over the package and ensure that the strapping is accessible to an operative on the opposite side of the package to the fork-lift truck or trolley, both at the bottom of the pallet (via the protruding fork end) and at the top of the package. The operative releases the free strap end 15 from the retaining mechanism, and pulls it upward toward the guiding mechanism. Known tools are then used to join the straps and sever the strapping downstream of the guiding mechanism. The friction feed of the guiding mechanism 46 and braking mechanism 90 of the dispensers 50 ensure that slack strapping is not lost. After manoeuvring the package into position, the fork-lift truck 30 is withdrawn from the package, and the free end of the strapping 15 can be pulled downwards from the guiding mechanism 46 to the retaining mechanism 42, and the operation repeated.

It will be readily apparent that a large number of modifications to embodiments of the present invention herein described may readily be made without departing from the true spirit or scope of the invention, and it is intended that these are encompassed by the appended claims.

I claim:

1. Strapping apparatus for applying strapping (14) to packages (10), said strapping apparatus comprising:

at least one fork (32) having a proximal end (40) and a distal end (41), and having retaining means (42) for gripping said strapping at said distal end;

guide mens (46) cooperative with said at least one fork (32), for feeding said strapping (14) therethrough to said retaining means (42);

dispensing means (50) cooperative with said guide means (46) for supplying strapping material (14) to said retaining means (42) and said guide means (46).

2. Strapping apparatus according to claim 1 wherein said guide means (46) include a friction device (86) for allowing said strapping (14) to be fed therethrough only upon applying greater than a predetermined force to said strapping.

3. Strapping apparatus according to claim 1 wherein said dispensing means (50) comprises a roll of strapping material rotatably mounted and including a braking mechanism (90) for allowing the supply of strapping material (14) to said guide means (46) only upon applying greater than the predetermined force to said strapping.

4. Strapping apparatus according to claim 1, wherein said fork (32) is mounted in a substantially horizontal orientation, and adapted to enable said distal end (41) to pass beneath said package (10) for strapping, and said guide means (46) is located in a position substantially vertically above said distal end (41) of said fork (40).

5. Strapping apparatus according to claim 4 wherein said guide means (46) is mounted on an arm (44,45) extendable in a substantially horizontal direction above said fork (32).

6. Strapping apparatus according to claim 4 wherein said guide means (46) is mounted on an arm (44,45), said arm having a proximal end and a distal end, said guide means (46) being mounted on said distal end, and said arm (44) being pivotally mounted at said proximal end of said arm.

7. Strapping apparatus according to claim 1, said strapping apparatus being integrally mounted onto a fork-lift truck (30).

8. Strapping apparatus according to claim 1, said strapping apparatus being integrally mounted onto a pallet truck.

9. A detachable fork extension for use with a fork (32) of the apparatus of claim 1, said extension including retaining means (42) forming an integral part thereof, for gripping said strapping at the distal end (41) of said fork.

* * * * *